US007383923B2

(12) United States Patent
Patten et al.

(10) Patent No.: US 7,383,923 B2
(45) Date of Patent: Jun. 10, 2008

(54) ELEVATING LOAD PLATFORMS

(75) Inventors: Sidney A. Patten, Belgrave (AU); David M. Munro, Knoxfield (AU)

(73) Assignee: Amiata Holdings Pty Ltd., Victoria (AU)

( * ) Notice: Subject to any disclaimer, the term of this patent is extended or adjusted under 35 U.S.C. 154(b) by 385 days.

(21) Appl. No.: 11/141,206

(22) Filed: Jun. 1, 2005

(65) Prior Publication Data

US 2006/0283669 A1 Dec. 21, 2006

(51) Int. Cl.
*B66B 9/02* (2006.01)

(52) U.S. Cl. ..... 187/269; 187/240; 187/244; 108/105; 108/106; 108/136; 182/69.5; 182/69.6

(58) Field of Classification Search ..... 187/233, 187/244, 240, 269, 211; 108/76, 103, 104, 108/105, 136, 147; 312/59, 249, 249.8; 248/528, 248/188.3, 188.6; 182/69.5, 147
See application file for complete search history.

(56) References Cited

U.S. PATENT DOCUMENTS 4,764,075 A * 8/1988 Cox et al. ..... 108/136
4,867,277 A * 9/1989 Sloan ..... 187/243
4,926,760 A * 5/1990 Sack ..... 108/145
6,035,973 A * 3/2000 Neal et al. ..... 187/244
6,537,017 B2 * 3/2003 Stone ..... 414/672
6,651,775 B2 * 11/2003 Bassett, Jr. ..... 182/69.5

* cited by examiner

*Primary Examiner*—Peter M. Cuomo
*Assistant Examiner*—Stefan Kruer
(74) *Attorney, Agent, or Firm*—Stites & Harbison PLLC; Ross F. Hunt, Jr.

(57) ABSTRACT

An elevating load platform comprising a base member and a load supporting member interconnected by a linkage means that facilitates vertical movement of the load supporting member generally parallel to the base member, and a plurality of coil springs positioned to urge the load supporting member upwardly relative to the base member so that when the load supporting member is laden the coil springs are compressed, and as the load is progressively removed the coil springs urge the load supporting member upwards to thereby maintain the load supporting member at a desired height, the linkage means comprising a pair of spaced scissor linkages interconnected by a central cross-member, the plurality of compression springs being positioned in a spaced array interposed between the base member and the cross-member.

9 Claims, 4 Drawing Sheets

ELEVATING LOAD PLATFORMS

This invention relates to elevating load platforms, and in particular load platforms for use with palletised loads.

These days health and safety requirements place considerable emphasis on the need to protect operators from back injuries. The manual loading and unloading of pallets is particularly dangerous from the point of view of back injury, particularly when the operators must lift a load bending down to the base of a pallet.

There have thus been a number of proposals to ensure that the height of the load that is to be lifted in either a loading or unloading situation is at an optimum level. It is known to use electric or hydraulic means to raise and lower the platform and maintain it at the optimum height.

In Australian patents 571354 and 582692 it was suggested to use sets of coil springs calibrated in dependence of the load to again ensure that the platform is substantially at the optimum height as the platform is loaded or unloaded.

An issue with load elevators of the kind described in the earlier patents is the need to have a variety of sets of springs that have to be changed as the load is changed. In situations where the load varies from large, comparatively light produce to small and heavy produce it is clear that the force that the springs have to exert on the platform would vary considerably. Interchanging coil springs can be a difficult procedure and it is this issue that has brought about the present invention.

SUMMARY OF THE INVENTION

According to one aspect of the present invention there is provided an elevating load platform comprising a base member and a load supporting member interconnected by a linkage that facilitates vertical movement of the load supporting member generally parallel to the base member, and a plurality of coil springs positioned to urge the load supporting member upwardly relative to the base member so that when the load supporting member is laden the coil springs are compressed, and as the load is progressively removed the coil springs urge the load supporting member upwards to thereby maintain the load supporting member at a desired height, the linkage means comprising a pair of spaced scissor linkages interconnected by a central cross-member the plurality of compression springs being positioned in a spaced array interposed between the base member and the cross-member.

Preferably, the cross-member and the base member include spring support means that support the springs in use but facilitate simple removal and replaceability of the springs.

In a preferred embodiment, up to five coil springs can be used with the size, capacity and number of springs varying in dependence of the load that has to be lifted.

Preferably, the cross-member is pivotally secured to the linkages so that the member pivots as the load supporting member moves.

Preferably, a damper is positioned between the load supporting member and the base.

In a preferred embodiment, the cross-member is coupled to the base via a linkage that causes the cross-member to axially pivot as the load supporting member moves vertically.

The load supporting member may support a rotatable turntable.

Preferably, one end of each scissor linkage at the base member and load supporting member is adapted to slide along a rail to facilitate the movement.

In a preferred embodiment the platform includes means to urge that end of each scissor linkage along the rail to lift the cross-member so that end of the linkage can be released from the rail to allow the load supporting member to be lifted to such a height that the springs become disengaged from the spring support means thereby facilitating replacement.

DESCRIPTION OF THE DRAWINGS

An embodiment of the present invention will now be described by way of example only with reference to the accompanying drawings in which.

DESCRIPTION OF THE PREFERRED EMBODIMENT

Figure 1:
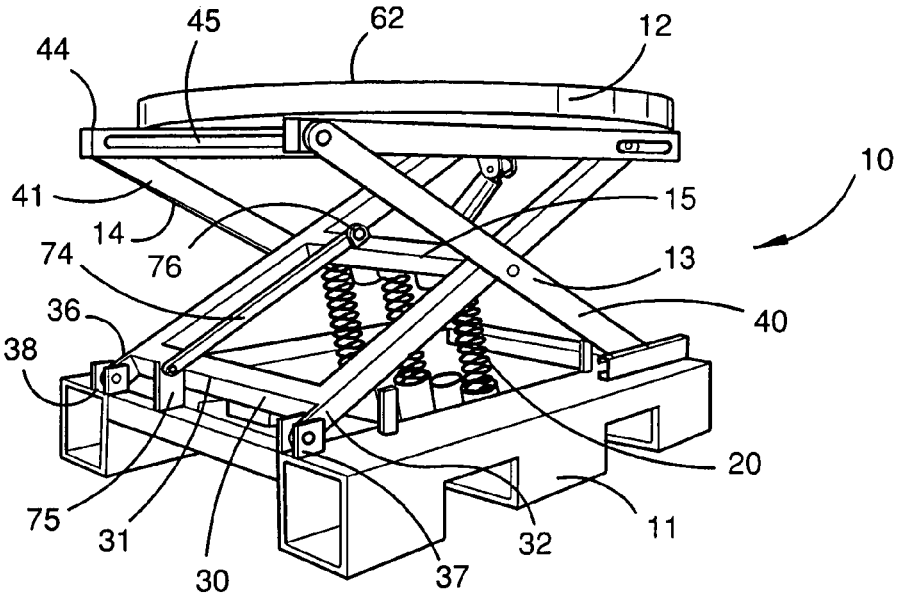
FIG. 1 is a perspective view of an elevating load platform viewed from the front.
Figure 2:
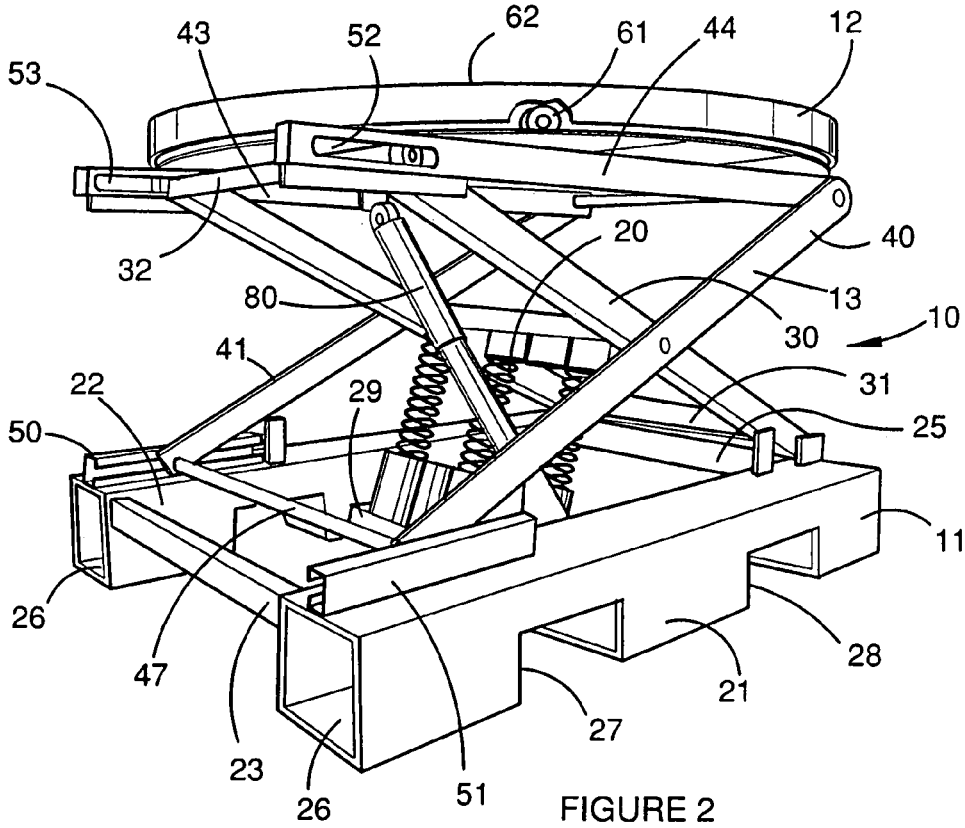
FIG. 2 is a perspective view of the load platform viewed from the rear.
Figure 3:
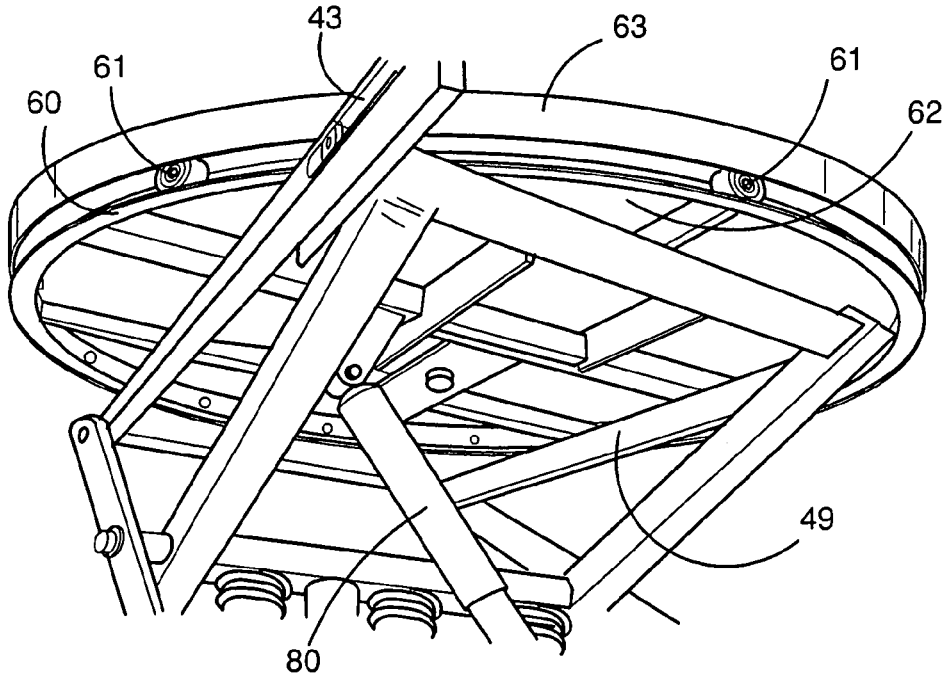
FIG. 3 is a perspective view illustrating the underside of the load supporting platform.
Figure 4:
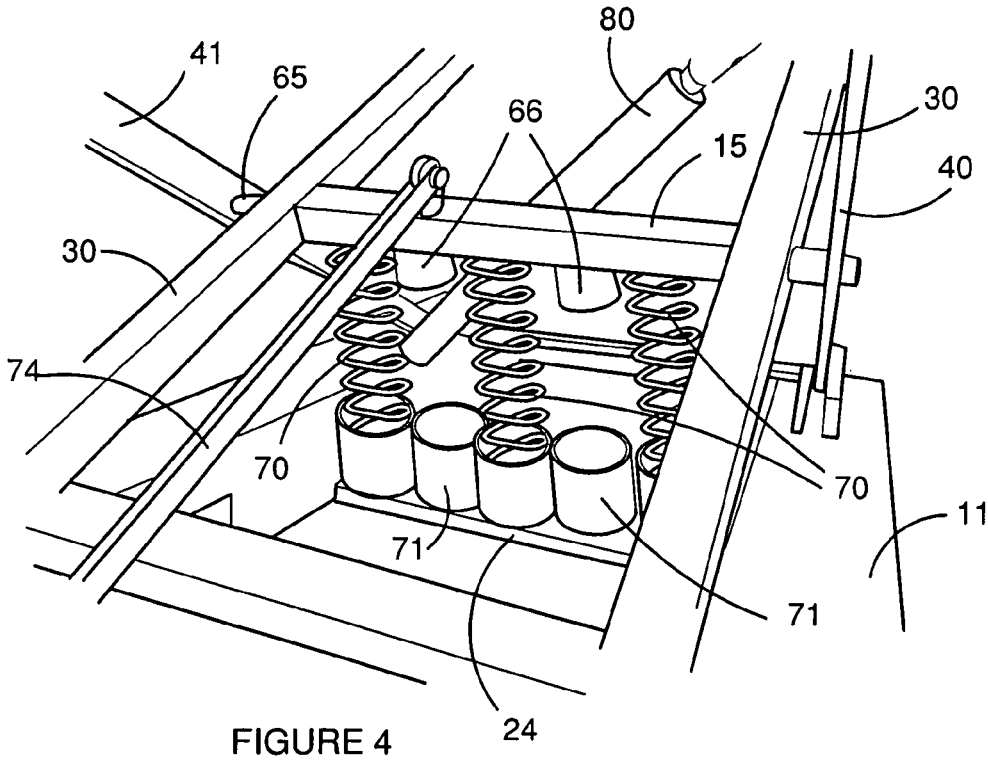
FIG. 4 is a perspective view illustrating location of springs.

As shown in the accompanying drawings, an elevating load platform 10 comprises a base structure 11 that supports a load supporting platform 12. The base support and load support platform are interconnected by scissor linkages 13, 14 that are mounted to extend along two parallel sides of the platform. The scissor linkages 13, 14 are joined by a central cross-member 15 and an array of coil springs 20 are positioned between the base structure 11 and the underside of the cross-member 15 the scissor linkages 13, 14 and the coil springs 20 operate to urge the load supporting platform 12 upwardly parallel to the base structure 11.

The base structure 11 is fabricated from steel and can provide two elongate parallel spaced bearers 21, 22 joined by cross-members 23, 24, 25. The elongate bearers 21, 22 define forklift tine entry 26 at either end. The elongate bearers also have rectangular cutouts 27, 28 along their sides defining forklift tine entry from opposite sides. Thus, the load platform 10 can be lifted by a forklift from either side or either end. Pallet lifters can also be used to lift and transport the platform 10.

In an embodiment (not shown) it is understood that the base structure 11 can also be mounted on castors.

The pair of scissor linkages 13, 14 are defined by a first rectangular frame 30 of square metal section that has top and bottom cross-members 31, 32. Each end of the bottom cross-member 31 has a downwardly extending flange 35, 36 that are each bolted to a pair of upstanding lugs 37, 38 that project upwardly from one end of the base structure 11. The attachment allows the frame 30 to pivot about the lugs 37, 38. The center of the rectangular frame 30 is pivotally coupled on each side to diagonal stays 40, 41 that are in turn bolted at their upper ends to the ends of horizontal bearers 43, 44. A cross-member 45 interconnects the upper ends of the stays 40, 41 across the bearers 43, 44. The other end of the diagonal stays 40, 41, namely the lower end, is interconnected by a cross-member 47 that in turn supports small rollers 48, 49 that run in an open track 50, 51 on either side of the base structure 11. The upper end of the rectangular frame 30 has the cross-member 32 arranged to be a sliding fit with elongate slots 52, 53 at either end of horizontal bearers 43, 44. In this way the bearers 43, 44 can move up and down vertically as the scissor linkages 13, 14 are compressed or expanded with the relative horizontal movement being afforded at one end of the platform 10.

The elongate bearers 43, 44 at the top of the platform 10 are welded to a circular support structure 60 that has peripherally positioned rollers 61 on which a circular loaded platform 62 with a downwardly extending annular skirt 63 that is arranged to be a running fit to constitute a turntable.

The cross-member 15 at the center of the scissor linkages 13, 14 is a square section tube that is adapted to pivot relative to a shaft 65 that extends across the diagonal struts and through the rectangular frame 30. The underside of the cross-member 15 is provided with five cylindrical projections 66 that are equally spaced along the cross-member 15. The cylindrical projections 66 are adapted to fit within a coil spring 70, the opposite end of which is located in an upstanding enclosure 71 that is welded to the cross-member 24 that extends across the center of the base structure 11. In this way five coil springs 70 can be held captive by the respective downwardly extending male projections 70 and upwardly extending female recesses 71 defined by the cross-member 15 and cross-member 24 of the base structure respectively. As shown in FIG. 1, the cross-member 15 is also coupled to the base structure via a linkage 74 that is bolted to an upstanding web 75 at one end of the base structure 11 and to a smaller web 76 projecting upwardly from the cross-member 15. The linkage 74 ensures that any movement of the cross-member imparts a pivotal rotation of the cross-member 15 to ensure that the springs 70 remain axially located on the male projection 66.

Figure 5:
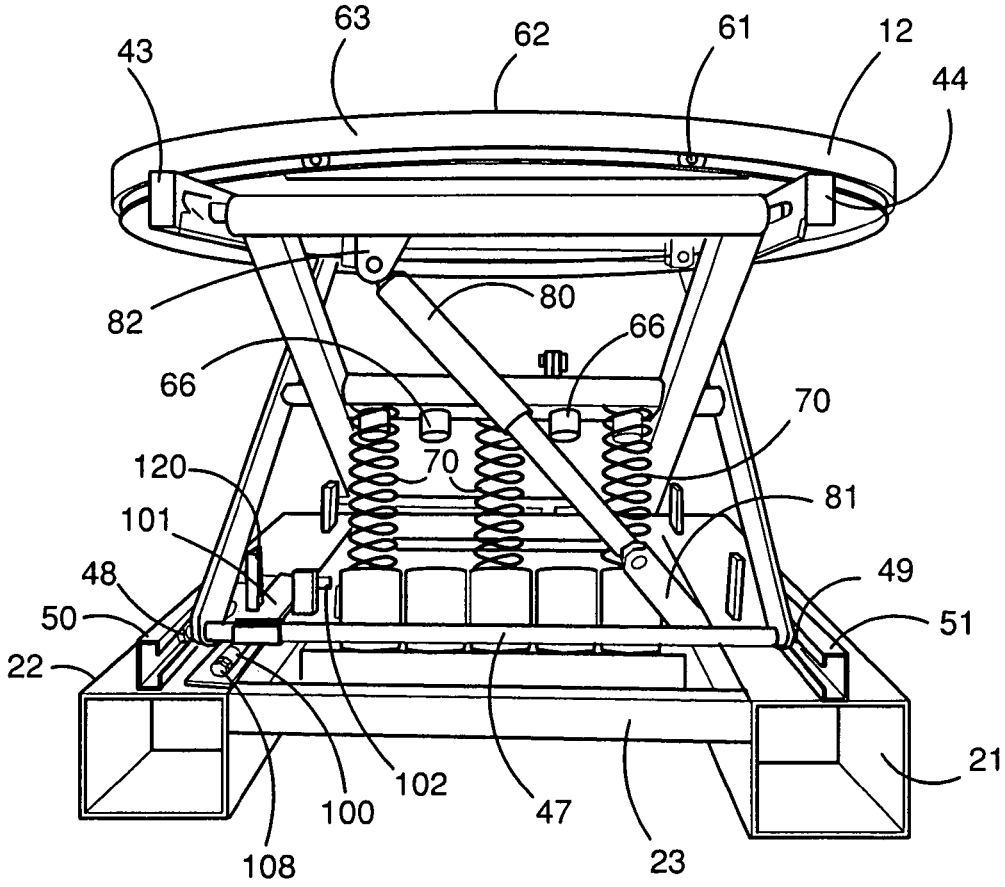
FIG. 5 is a perspective view taken from the rear of the elevating load platform.

As shown in FIG. 5, a gas strut or damper 80 is also bolted with one end coupled to projecting flanges 81 from the interior of one side of the base structure 11 and the other end being bolted to a pair of parallel webs 82 extending downwardly from the support structure 60 of the loading platform 12.

The scissor linkage 13, 14 of the assembly allows the loading platform to move in a vertical distance of about 300 mm and the coil springs 70 control that movement. By suitable selection of the number and/or the rating of the springs for a particular load, the platform 10 can be designed in a manner that a full palletized load presses the platform 12 fully down allowing ready access to the top of the pallet. As the top layer is removed, springs 70 urge the loading platform 12 upwardly again maintaining the constant height until when the pallet is empty the platform has been raised to its full height shown in the drawings.

In a preferred embodiment the load capacity of the platform varies in accordance with the number of springs 70. Five identical springs provide support for the greatest load capacity 1200 kg whilst the number of springs are reduced to four, three, two or even one as the load demand reduces. In other embodiments, springs of differing capacities can be selected or secondary springs can be located within the existing springs to increase the load capacity.

Figure 6:
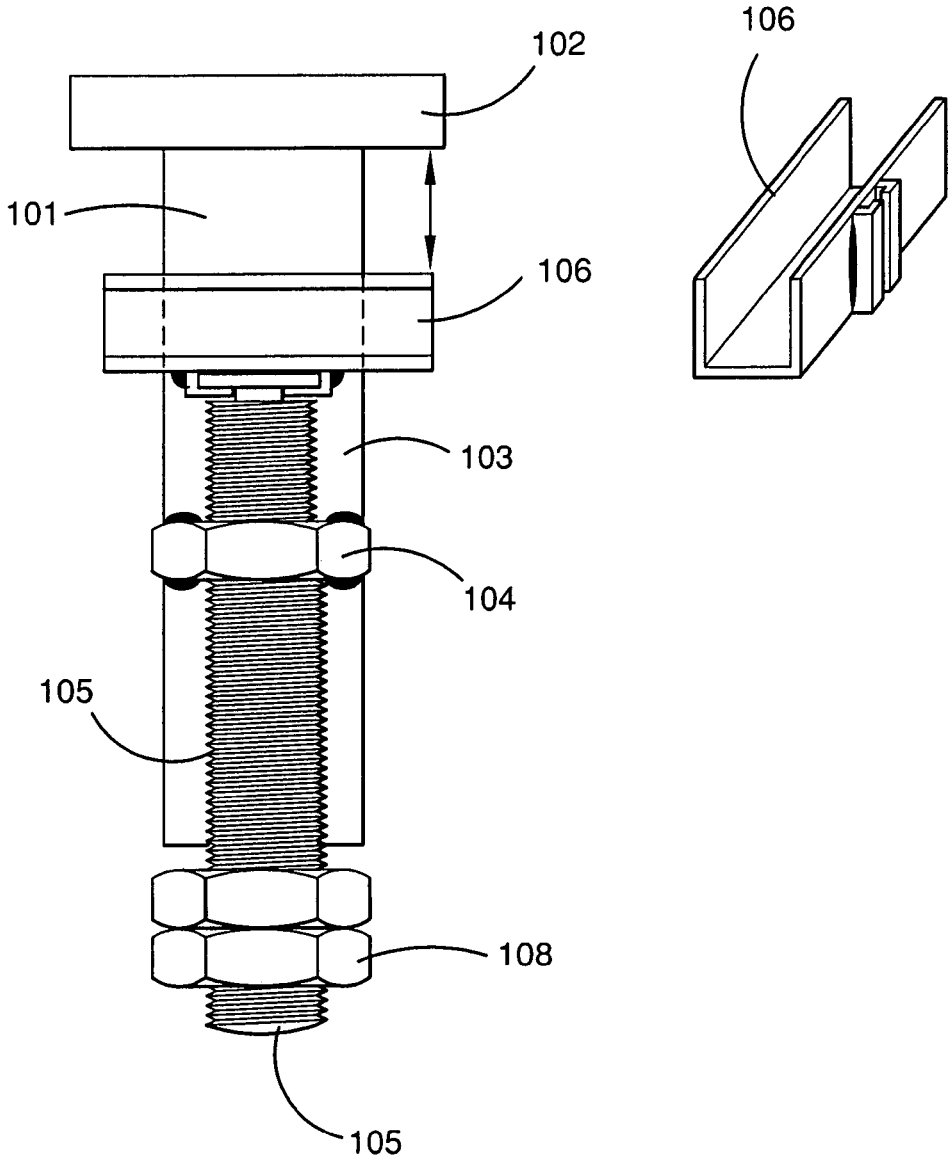
FIG. 6 is a plan view of an adjustment jack for use to lift the platform for adjustment purposes.

To remove or replace springs an adjustment or screw jack 100 of the kind shown in FIG. 6 is placed adjacent one rail. The jack 100 comprises a T bar 101 having a cross head 102 and elongate shank 103 that is welded to a nut 104. An external threaded drive 105 terminating at one end of an open channel drive 106 is threadedly engaged with the nut 104. The driver 105 has a turning nut or pair of lock nuts 108 at the opposite end. As shown in FIG. 5 the T bar 101 is slid under the cross-member 47 flat against the bearer 22 and the cross head 102 is positioned behind a pair of spaced lugs 120, 121 that project upwardly from bearer 22, and the open channel drive 106 is engaged against the cross-member 47. By turning the lock nuts 108 the driver pushes the cross-member 47 towards the cross head 102 causing the scissor linkages to lift. By further turning of the lock nuts 108 the scissor linkages can be lifted until the springs 70 are released from the cross-member 15. It is necessary to disconnect the damper 80 before jacking up the scissor linkages.

The adjustment jack 100 firmly and positively locates the scissor mechanisms in an elevated position facilitating removal and replacement of springs without danger of collapse of the platform 10. At this height the male downward projections of the cross-member escapes from the end of the spring and it is a simple matter to remove and/or replace the coil springs from the female recesses as necessary. The platform can then be lowered through turning the lock nuts 108 of the jack 100 backwards until the male projections engage within the ends of the coil springs. When the jack 100 is not in use it is removed from the bearer 21 and stored against one of the cross-members of the base structure.

The gas damper 80 is for the purpose reducing shock loads and controlling the speed of both depression and return of the loading platform. It is further understood that an additional safety feature, preventing collapse of the structure when springs are being replaced, is a stay (not shown) that interconnects the base structure and the mounting platform in an elevated position facilitating spring replacement.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An elevating load platform comprising a base member and a load supporting member interconnected by a linkage assembly that facilitates vertical movement of the load supporting member generally parallel to the base member, and a plurality of coil springs positioned to urge the load supporting member upwardly relative to the base member so that when the load supporting member is laden, the coil springs are compressed, and as the load is progressively removed, the coil springs urge the load supporting member upwardly to thereby maintain the load supporting member at a desired height, the linkage assembly comprising a pair of spaced scissor linkages interconnected by a central cross-member, each scissor linkage comprising two crossed arms pivotally secured together at the centers thereof by the cross-member, the plurality of compression springs being positioned in a spaced array interposed between the base member and the cross-member, and a linkage coupled between the base member and the cross member to cause the cross-member to axially pivot as the load supporting member moves vertically so as to ensure constant alignment of the springs with the base member and cross-member.

2. The elevating load platform according to claim 1 wherein the cross-member and the base member include a spring location device that locates the springs in use but facilitates simple removal and replaceability of the springs.

3. The elevating load platform according to claim 1 wherein up to five of said coil springs are provided in a spaced array with the size, capacity and number of springs varying in dependence of the load that has to be lifted.

4. The elevating load platform according to claim 1 wherein a damper is positioned between the load supporting member and the base member.

5. The elevating load platform according to claim 1 wherein the load supporting member is supported on a rotatable turntable.

6. The elevating load platform according to claim 1 wherein one end of each scissor linkage at the base member and load supporting member is slidable relative to the base member or load supporting member to facilitate the movement.

7. The elevating load platform according to claim 6 wherein a displacement means is provided for displacing said one end of each scissor linkage to lift the cross-member so said one end of the linkage can be released from allowing the load supporting member to be lifted to such a height such that the springs can be disengaged thereby facilitating replacement.

8. The elevating local platform according to claim 7 wherein the displacement means comprises a screw-jack.

9. An elevating load platform comprising a base member and a load supporting member interconnected by a linkage assembly that facilitates vertical movement of the load supporting member generally parallel to the base member, and a plurality of coil springs positioned to urge the load supporting member upwardly relative to the base member so that when the load supporting member is laden, the coil springs are compressed, and as the load is progressively removed, the coil springs urge the load supporting member upwardly to thereby maintain the load supporting member at a desired height, the linkage assembly comprising a pair of spaced scissor linkages interconnected by a central cross-member, each scissor linkage comprising two crossed arms pivotally secured together at the centers thereof by the cross-member, the plurality of compression springs being positioned on spring locators, positioned on the cross-member and in a spaced array interposed between the base member and the cross-member, so as to locate the springs in use and to facilitate simple removal and replaceability of the springs, and a linkage coupled between the base member and the cross-member so as to axially pivot as the load supporting member moves vertically to thereby ensure constant alignment of the springs with the base member and the cross-member.

* * * * *